US007551987B2

(12) United States Patent
Ota

(10) Patent No.: US 7,551,987 B2
(45) Date of Patent: Jun. 23, 2009

(54) ILLUMINATING APPARATUS, IMAGE CAPTURING APPARATUS, AND MONITORING APPARATUS, FOR VEHICLE DRIVER

(75) Inventor: Shunji Ota, Kyoto (JP)

(73) Assignee: OMRON Corporation, Kyoto (JP)

( * ) Notice: Subject to any disclaimer, the term of this patent is extended or adjusted under 35 U.S.C. 154(b) by 495 days.

(21) Appl. No.: 11/371,431

(22) Filed: Mar. 9, 2006

(65) Prior Publication Data

US 2006/0212202 A1 Sep. 21, 2006

(30) Foreign Application Priority Data

Mar. 10, 2005 (JP) ..... 2005-067254

(51) Int. Cl.
*G08B 21/06* (2006.01)

(52) U.S. Cl. ..... 701/1; 340/576; 382/104

(58) Field of Classification Search ..... None
See application file for complete search history.

(56) References Cited

U.S. PATENT DOCUMENTS 5,689,241 A * 11/1997 Clarke et al. ..... 340/575
5,786,765 A * 7/1998 Kumakura et al. ..... 340/576
6,400,835 B1 * 6/2002 Lemelson et al. ..... 382/118
6,496,117 B2 * 12/2002 Gutta et al. ..... 340/576
6,717,518 B1 * 4/2004 Pirim et al. ..... 340/576
7,202,792 B2 * 4/2007 Zhang et al. ..... 340/575
2003/0142849 A1 7/2003 Lemelson et al.
2004/0047058 A1 * 3/2004 Unno et al. ..... 359/883

FOREIGN PATENT DOCUMENTS

JP 11-304428 11/1999
JP 2004-58799 2/2004
JP 2005-247014 * 9/2005

OTHER PUBLICATIONS

Patent Abstracts of Japan, Publication No. 11-304428, Publication Date: Nov. 5, 1999, 1 page.
Patent Abstracts of Japan, Publication No. 2004-058799, Publication Date: Feb. 26, 2004, 1 page.

* cited by examiner

*Primary Examiner*—Michael J. Zanelli
(74) *Attorney, Agent, or Firm*—Osha • Liang LLP

(57) ABSTRACT

A driver illuminating apparatus adapted for use in a vehicle includes a light emitting element mounted within a rear field of vision of a driver of the vehicle through a rear-view mirror, for emitting infrared radiation toward the mirror. Alternatively, a driver illuminating apparatus includes a light emitting element mounted out of a rear field of vision of a driver through a rear-view mirror, for emitting infrared radiation to be reflected by a cold filter and delivered to the mirror. The cold filter is provided in part or whole of a portion of a rear window of the vehicle. The portion is located within the rear field of vision. Further alternatively, a driver illuminating apparatus adapted for use in a car includes a light emitting element mounted approximately at the center of a rear window of the car, for emitting infrared radiation toward an interior rear-view mirror.

19 Claims, 6 Drawing Sheets

ILLUMINATING APPARATUS, IMAGE CAPTURING APPARATUS, AND MONITORING APPARATUS, FOR VEHICLE DRIVER

CROSS REFERENCE

This Nonprovisional application claims priority under 35 U.S.C. § 119(a) on Patent Application No. 2005-067254 filed in Japan on Mar. 10, 2005, the entire contents of which are hereby incorporated by reference.

BACKGROUND OF THE INVENTION

The invention relates to illuminating apparatus for illuminating a face of a driver of a vehicle, to image capturing apparatus for capturing a facial image of the driver by use of the illuminating apparatus, and to monitoring apparatus using the image capturing apparatus. In order to prevent vehicle accidents due to driving errors, driver monitoring apparatus have been proposed that are adapted to capture an image of a face of a driver of a vehicle, particularly of his or her eyes and an area therearound, to monitor based on the captured image whether the driver falls asleep or inattentive, and, upon detection of drowsy or inattentive driving, to perform a countermeasure operation, such as of providing a warning to the driver.

Such driver monitoring apparatus are adapted to analyze a driver's image captured by a camera. Because of directly received outside light, however, a vehicle cabin, in particular a driver seat, generally provides the least ideal conditions for the camera to capture images. At daytime, the driver seat shows extremely high luminance levels due to direct sunlight. At nighttime, in contrast, the driver seat shows extremely low luminance levels due to absence of lighting. In a situation such as where the vehicle passes through a tunnel, in addition, the driver seat shows a random alternation of extremely high and low luminance levels. In order to provide stable conditions for image capturing, i.e., stable luminance, JP 2004-058799A discloses a driver monitoring apparatus that uses infrared radiation to illuminate a driver. More specifically, the apparatus of JP 2004-058799A is adapted to illuminate a driver's face by infrared radiation that is emitted by an infrared light emitting element and reflected by a cold filter. The infrared light emitting element is disposed on a dashboad and out of the driver's line of vision. The cold filter is formed on a surface of instrument panel.

However, the prior art apparatus has the following problems.

(1) The prior art apparatus has an illuminating apparatus fixedly mounted. Drivers have different eye levels depending on their physical constitution. A driver has different eye levels depending on his or her positions, driver seat adjustments, etc. Accordingly, the illuminating apparatus is required to illuminate a wide area in order to illuminate eyes of a driver, with any physical constitution and in any position, seated in a driver seat in any adjustment position. Therefore, the light emitting element is required to have a high luminance. The prior art apparatus is thus disadvantageous in difficulty in downsizing the illuminating apparatus, and in high power consumption and manufacturing costs.

(2) The prior art apparatus has the illuminating apparatus disposed in front of a driver in order to illuminate his or her face. However, a number of essential instruments and gauges are also provided in front of the driver. The prior art apparatus is thus disadvantageous in that interior design of the vehicle causes the illuminating apparatus to be disposed at a limited location.

In light of the foregoing problems, a feature of the invention is to provide a driver illuminating apparatus that is adapted to illuminate a face, in particular eyes and an area therearound, of a driver of a vehicle; a driver image capturing apparatus employing the illuminating apparatus, adapted to capture an image of the driver for facilitated facial recognition; and a driver monitoring apparatus employing the image capturing apparatus.

SUMMARY OF THE INVENTION

A driver illuminating apparatus adapted for use in a vehicle provided with a rear-view mirror according to an aspect of the invention includes a light emitting element mounted within a rear field of vision of a driver of the vehicle through the rear-view mirror. The light emitting element is adapted to emit infrared radiation toward the rear-view mirror.

According to this aspect, the light emitting element emits infrared radiation toward the rear-view mirror from the driver's rear field of vision, so that the infrared radiation is reflected by the rear-view mirror and delivered to a face (in particular, eyes and an area therearound) of the driver. Although the light emitting element may be mounted at any location within the driver's rear field of vision, the element is preferably located approximately at center of the field of vision in order for the infrared radiation properly to be delivered to the eyes and the area therearound. The light emitting element can be mounted above the center of the field of vision in order for the infrared radiation properly to be delivered to an area around a nose or mouth of the driver.

The illuminating apparatus according to this aspect of the invention eliminates the need for adjusting orientation of the light emitting element to the driver's physical constitution. This is because the driver adjusts the angle of the rear-view mirror to his or her physical constitution. Thus, the illuminating apparatus is allowed properly to illuminate the face of the driver. The illuminating apparatus also eliminates the need for high luminance (total amount of radiation) for the light emitting element. This is because the element has only to emit a narrow angle of radiation to the rear-view mirror.

Further, the light emitting element (e.g., LED) hardly obstructs the driver's rear field of vision because the element is smaller in size than a camera such as disclosed in JP H11-304428A that is mounted at a location rearward of a driver seat and adapted to capture an image of a driver through an interior rear-view mirror.

A driver illuminating apparatus adapted for use in a vehicle provided with a rear-view mirror according to another aspect of the invention includes a light emitting element mounted out of a rear field of vision of a driver of a vehicle through the rear view mirror. The light emitting element is adapted to emit infrared radiation to be reflected by a cold filter and delivered to the rear view mirror. The cold filter is provided in part or whole of a portion of a rear window of the vehicle. The portion is located within the rear field of vision.

According to this aspect, the light emitting element is mounted out of the rear field of vision of the driver. The infrared radiation emitted by the element is reflected first by a portion of the rear window within the field of vision and then by the rear view mirror, and delivered to a face of the driver.

This aspect of the invention prevents the element from obstructing the driver's field of vision while allowing the element to illuminate the face of the driver through the rear-view mirror. This is because of the characteristics of the cold filter that it transmits visible light and reflects infrared radiation.

A driver image capturing device adapted for use in a vehicle provided with a rear-view mirror according to another aspect of the invention includes any one of the driver illuminating apparatus as described above, and a camera mounted so as to be directed at a face of the driver.

According to this aspect, the illuminating apparatus illuminates the face of the driver with infrared radiation through the rear-view mirror, and the camera is used to capture an image of the driver including the illuminated face. The illuminating apparatus thus provides proper conditions for image capturing, thereby facilitating facial detection or recognition compared to image capturing in an unilluminated or entirely illuminated space. Thus, this aspect of the invention allows precise determination of condition of the driver.

DETAILED DESCRIPTION OF THE INVENTION

Figure 1:
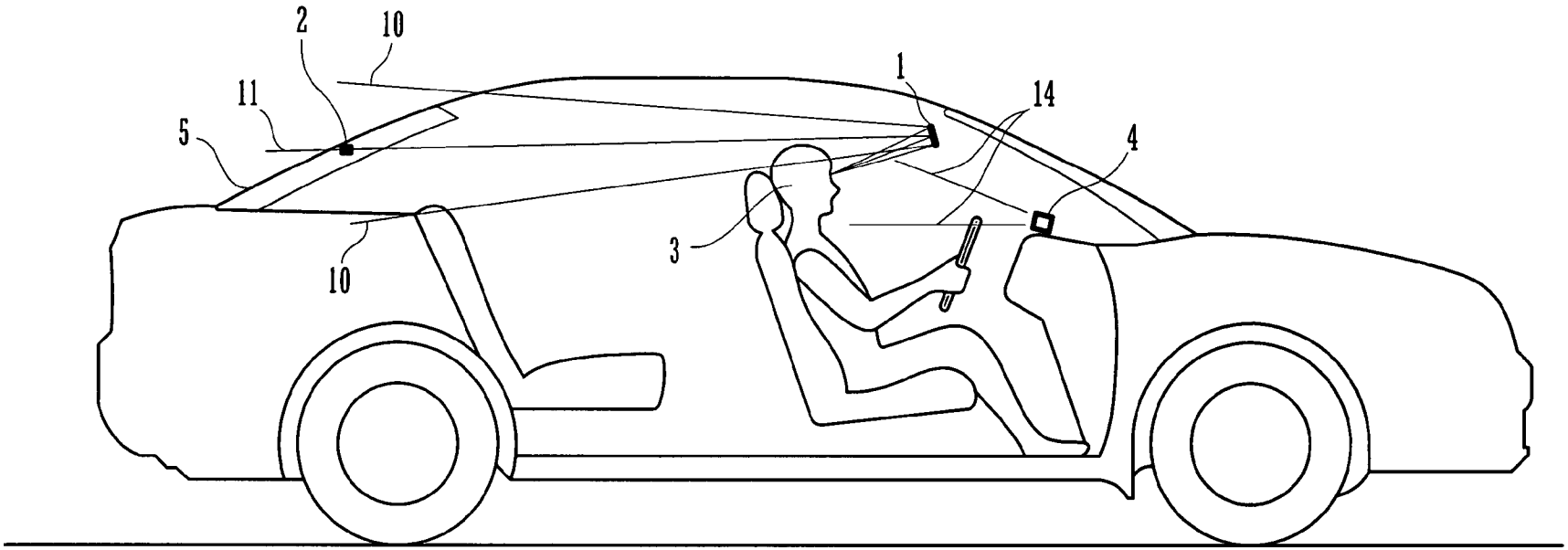
FIG. 1 is a schematic diagram illustrating a driver image capturing apparatus according to a first embodiment of the invention.

FIG. 1 is a diagram illustrating a schematic configuration of a driver image capturing apparatus according to a first embodiment of the invention. The driver image capturing apparatus is adapted to illuminate a face of a driver of a car in a driver seat with near-infrared radiation that is emitted from rearward of the driver and reflected by a rear-view mirror. A camera is mounted on a dashboard immediately in front of the driver in order to capture a facial image of the driver.

The captured image is supplied to a processing device for facial recognition, determination of rear-view mirror angle, detection of, and warning against, drowsy or inattentive driving, etc.

FIG. 1 is a side view of a cabin of the car. With adjustable angles, a rear-view mirror 1 is provided near a roof at the center front of the cabin. Prior to operation of the car, a driver 3 in a driver seat manually adjusts the angle of the mirror 1 so that the driver 3 will be able to view an entire rear window 5 through the mirror 1, i.e., so that the driver 3 will be able to see traffic, etc., behind the car through the mirror 1 and the window 5. The mirror 1 as properly adjusted provides the driver 3 with a rear-view field 10 of vision.

An LED 2 for illuminating the face of the driver is provided on an inner surface of the window 5. The LED 2, which is a high-intensity infrared LED, emits near-infrared radiation. The LED 2 is preferably located on a center line 11 of the field 10. Specifically, the LED 2 can illuminate the face of the driver 3 through the mirror 1, as long as the LED 2 is located within the field 10. When located on the center line 11, the LED 2 can conveniently illuminate the eyes, and a predetermined area therearound, of the driver 3.

The LED 2 emits near-infrared radiation to the front of the cabin (i.e., toward the rear-view mirror 1). The infrared radiation is focused through a lens (not shown) or any other device into a beam, which strikes the mirror 1. Since the angle of the mirror 1 is adjusted by the driver 3, as described earlier, the infrared radiation reflected by the mirror 1 is properly delivered to the face of the driver 3 (in particular, the eyes and the area therearound).

Alternatively, the LED 2 can be provided on the roof so that infrared radiation emitted from the LED 2 is directed comparatively downward in order to be delivered to an area between the nose and mouth of the driver 3.

A camera 4 is mounted on a dashboard and directed at the face of the driver 3. The camera 4 continuously or intermittently captures facial images of the driver 3. The captured facial images are supplied to a processing device to be described later. The camera 4 has a field of view 14 sufficiently wide to cover at least the entire face of the driver 3.

The camera 4 is preferably a CMOS camera having a high dynamic range. Because of directly received outside light, a vehicle cabin, in particular a driver seat, generally provides the least ideal conditions for cameras to capture images, with extremely high and low luminance levels caused, for example, by daytime direct sunlight and nighttime darkness. A high-dynamic-range CMOS camera closely approximates the dynamic range, and the logarithmic response to light intensity, of the human eye. With a contrast radio of 10,000,000:1 brightest to lowest, the CMOS camera is capable of capturing images of two objects, in an identical view field, with respective illuminances of 0.01 lux and 100,000 lux.

Accordingly, the CMOS camera as the camera 4 allows capturing an image of a high-contrast object, such as a face exposed to direct sunlight, while preventing "blown-out highlights" and "flat shadows".

Figure 2:
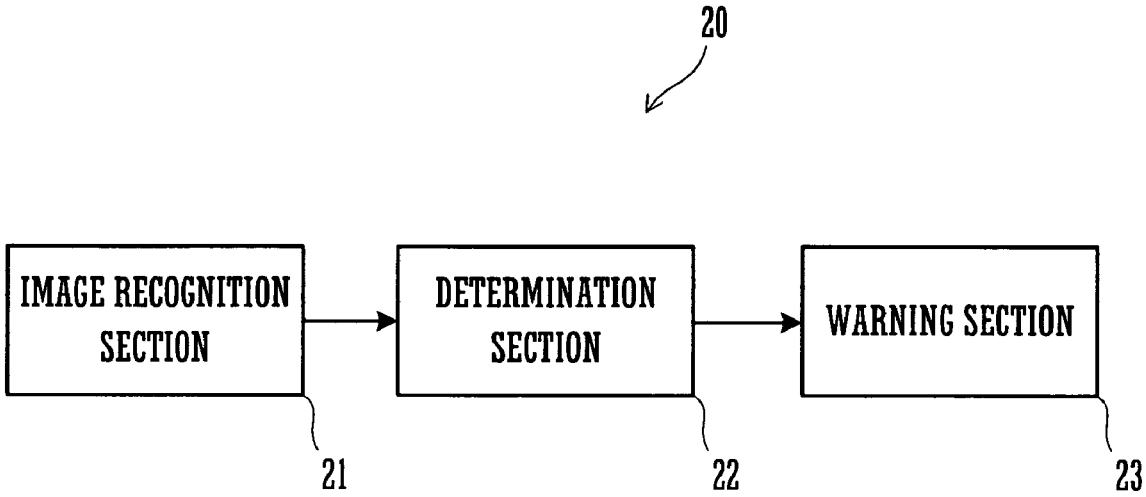
FIG. 2 is a block diagram illustrating a processing device that processes images captured by the image capturing apparatus.

FIG. 2 is a schematic block diagram illustrating a processing device 20 that processes an image captured by the camera 4. The processing device 20 includes an image recognition section 21, a determination section 22, and a warning section 23. The image recognition section 21 has a digital signal processor (DSP). From the captured image, the section 21 recognizes the face and eyes of the driver 3 based on a predetermined image recognition algorithm. Based on the facial and eye recognition, the determination section 22, which is a microcomputer, determines the driver 3's state of attention, etc., in order to perform operations for supplemental adjustment of rear-view mirror angle and for warning against drowsy or inattentive driving. According to the determined state, the warning section 23 provides an audible warning message, etc., to the driver 3.

Figure 3:
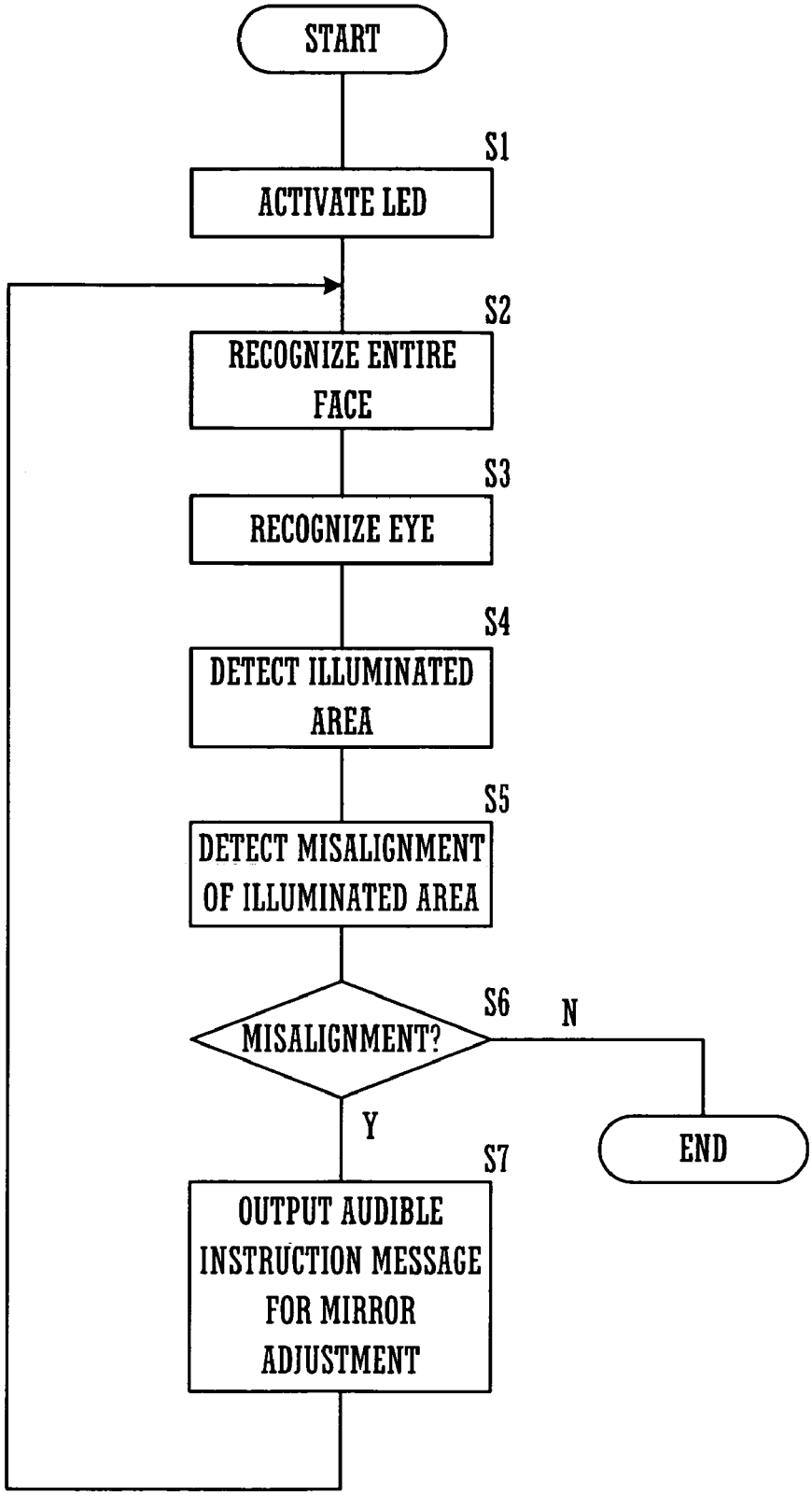
FIG. 3 is a flowchart illustrating steps taken in a process that the processing device performs.
Figure 4:
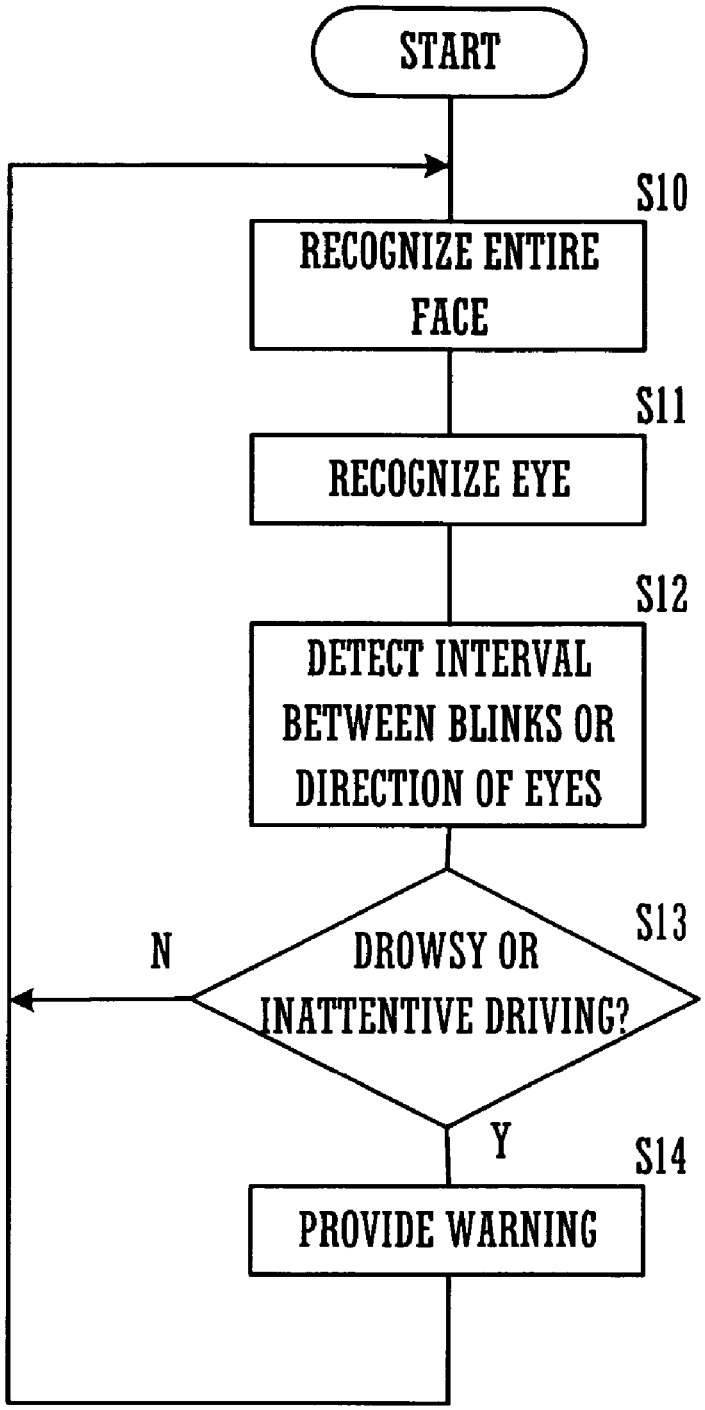
FIG. 4 is a flowchart illustrating steps taken in another process that the processing device performs.

Referring to FIGS. 3 and 4, described below are the operations that the section 22 performs. FIG. 3 is a flowchart illustrating steps taken in the operational process for supplemental adjustment of rear-view mirror angle. In the operation, the section 22 detects which part of the face of the driver 3 the infrared radiation strikes. If the infrared radiation does not strike the eyes of the driver 3, the section 22 activates the warning section 23 to output an audible message instructing the driver 3 to adjust the angle of rear-view mirror 3 so that the infrared radiation strikes the eyes.

A predetermined trigger, such as detection of the driver 3 sitting in the driver seat or turning on the ignition key, activates the LED 2 (step S1) as well as controls the camera 4 to capture an image of the driver 3 for facial recognition (step S2) and eye recognition (step S3). With a wide angle of view enough to cover the entire face of the driver 3, as described above, the camera 4 allows facial (eye) recognition, even without the infrared radiation emitted by the LED 2 properly striking the face. Particularly, the camera 4 as a high dynamic range CMOS camera (HDRC) allows capturing an image sufficient for facial recognition even under unfavorable conditions.

It is to be noted that the section 21 does not take the facial and eye recognition steps S2 and S3 separately, but that the section 21 recognizes the eyes out of an estimated entire facial structure. The above-described eye recognition is easier and more accurate than eye recognition out of a partial facial image.

Then, the section 22 detects an area that the LED 2 illuminates through the rear-view mirror 1 (step S4). The area is heinafter referred to the illuminated area. The illuminated area is detected by determining a high-illuminance facial area that extends horizontally. Next, the section 22 determines respective positions of the eyes and the illuminated area as detected (step S5). When the section 22 determines that the detected illuminated area matches an area around the eyes (step S6), which means that the angle of the mirror 1 is properly adjusted, the section 22 terminates the process. When determining that the detected illuminated area is misaligned from the area around the eyes, the section 22 activates the section 23 to output an audible message instructing the driver 3 to adjust the angle of the mirror 1 (step S7). Then, the process returns to step S1 for determination of readjustment result.

In a case where the detected illuminated area is misaligned upward from the eyes, for example, the audible message goes like this: "adjust the mirror downward". Instead of outputting the audible message, the section 23 may display a sign, such as an arrow, to indicate a direction in which the mirror 1 is to be adjusted. Such sign serves to notify the driver 3 not only that the mirror 1 is improperly angled, but also in which direction the mirror 1 is to be adjusted.

FIG. 4 is a flowchart illustrating steps taken in the operational process for warning against drowsy or inattentive driving. In the process, the section 22 determines drowsy or inattentive driving based on an interval between successive blinks or on a direction of the eyes, through continuous recognition of the eyes of the driver 3. When determining drowsy or inattentive driving, the section 22 activates the section 23 to provide a warning to the driver 3.

The camera 4 is controlled to capture images of the driver 3 at regular intervals for recognition of the entire face (step S10). The recognition of the entire face allows precise determination of face orientations, etc. The section 21 recognizes the eyes out of the entire face as recognized (step S11). For eye recognition, the section 21 mainly scans a portion of high illuminance of the recognized face where the near-infrared radiation emitted from the LED 2 is delivered through the mirror 1. This allows effective eye recognition. Based on the eye recognition result, the section 22 detects an interval between successive blinks, or a direction of the eyes, of the driver 3 (step S12). The detection may be made based on not only one recognition result, but also several recognition results. When determining that the interval is longer than a predetermined interval, the section 22 determines the possibility of drowsy driving (step S13), and activates the section 23 to provide a warning to the driver 3 (step S14). Also, when determining that the eyes are directed in a direction other than forward, the section 22 determines the possibility of inattentive driving (step S13), and activates the section 23 to provide a warning to the driver 3 (step S14).

The warnings provided by the section 23 may include, but are not limited to, the following: an audible alarm; an audible message that goes like this: "drowsy (inattentive) driving is dangerous"; or a mechanical warning action such as of shaking the driver seat.

In either process, the eyes and the area therearound are illuminated by the LED 2 through the mirror 1. This facilitates eye recognition, thereby allowing an increased process speed.

Figure 5:
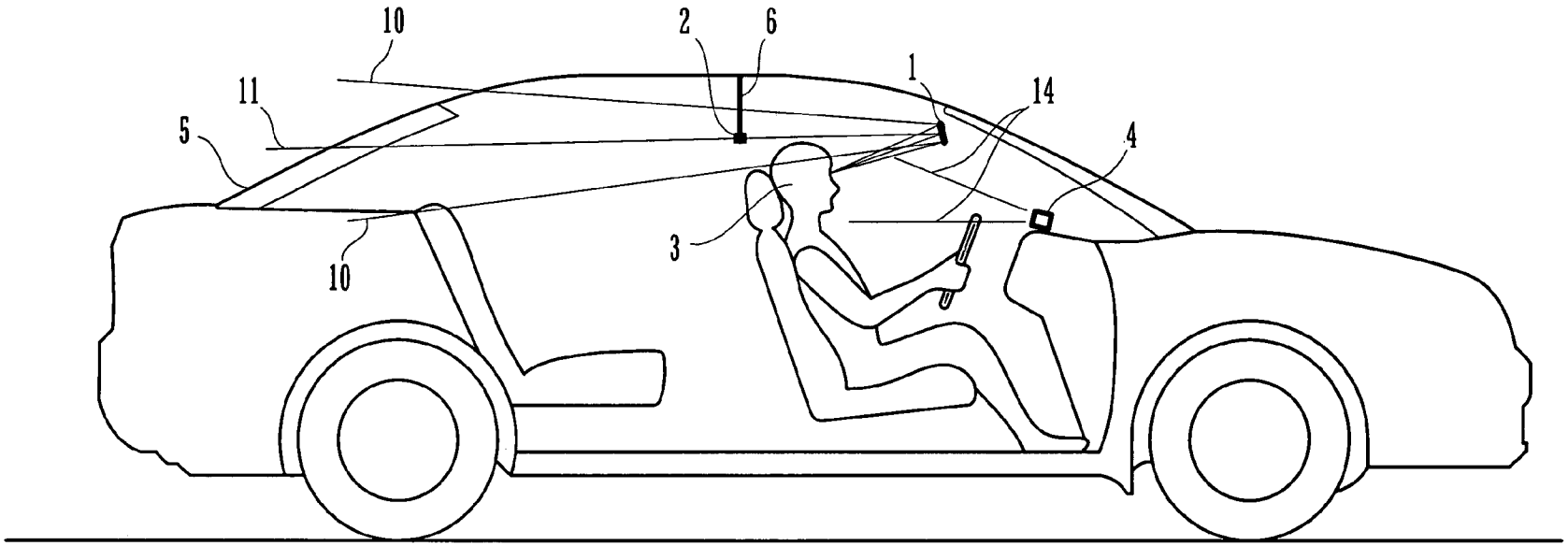
FIG. 5 is a schematic diagram illustrating a driver image capturing apparatus according to a second embodiment of the invention.
Figure 6:
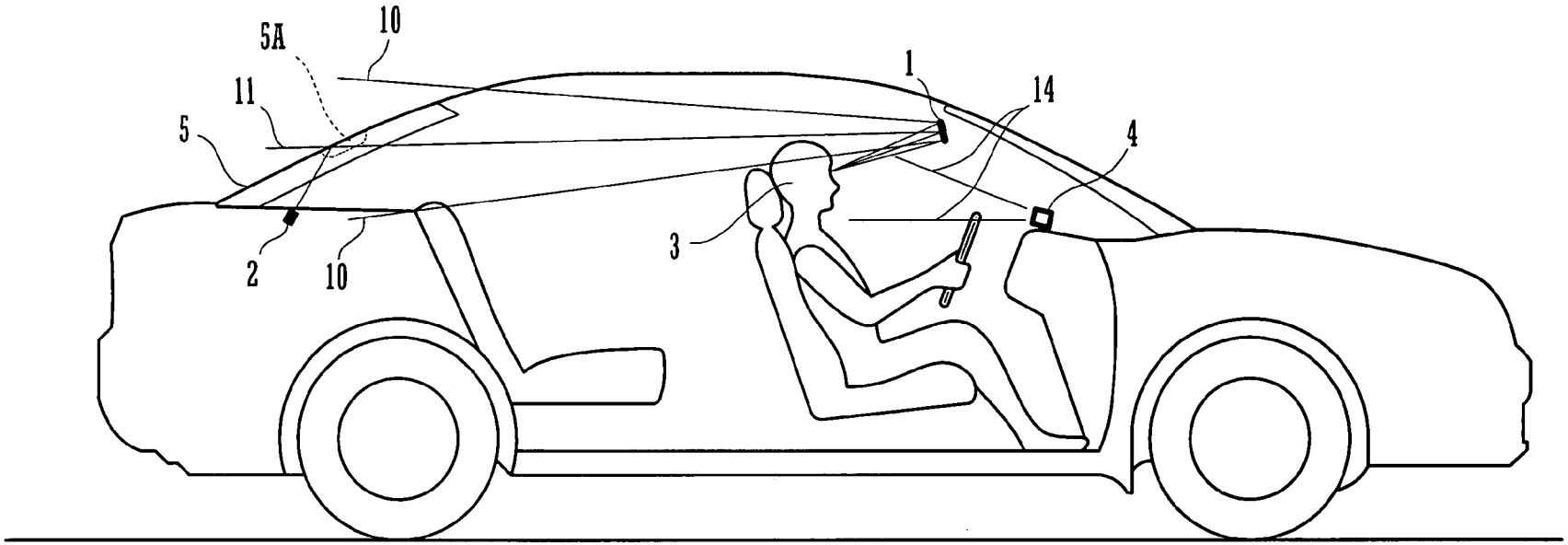
FIG. 6 is a schematic diagram illustrating a driver image capturing apparatus according to a third embodiment of the invention.

FIGS. 5 and 6 are schematic diagrams illustrating respective driver image capturing apparatus according to second and third embodiments of the invention.

In the second embodiment as shown in FIG. 5, the LED 2 is suspended from the roof approximately in the center of the vehicle cabin (i.e., approximately midway between the driver and front passenger seats and a backseat) by an arm 6. The LED 2 is located on the center line 11 of the rear-view field 10 of vision of the driver 3. The placement of the LED 2 near the mirror 1 ensures a wide angle of view of the mirror 1 from the LED 2, thereby allowing the LED 2 to illuminate through the mirror 1 a wide area of the face of the driver 3.

The arm 6 may be mounted on the roof either fixedly or movably so that the arm 6 can be flipped up, manually or automatically, when needed.

In the third embodiment as shown in FIG. 6, the LED 2 is located out of the rear-view field 10 of vision of the driver 3. Infrared radiation emitted from the LED 2 is reflected by the rear window 5, so that an axis of the reflected radiation lies on the center line 11 of the field 10. It is necessary that the window 5 is at once transparent to visible light so as to ensure a view behind the car for the driver 3 and opaque (i.e., reflective) to near-infrared radiation so as to reflect the infrared radiation emitted by the LED 2. Thus, the window 5 has a cold filter portion 5A that transmits visible light but reflects near-infrared radiation. The portion 5A is provided at least in an area around a contact point of the window 5 with the center line 11. The portion 5A is formed by mounting on the window 5 of transparent glass a sheet of film having the characteristics of cold filter, i.e., near-infrared reflectivity and visible light transmission.

The portion 5A as thus provided allows the LED 2 to be located out of the rear-view field 10 and prevents the LED 2 from obscuring the vision of the driver 3.

The portion 5A with the cold-filter characteristics allows the window 5 to provide surface emission of infrared radiation that enables illumination of the entire face of the driver 3 through the mirror 1.

The rear-view mirror of the invention provided for reflecting near-infrared radiation includes, but is not limited to, the interior rear-view mirror 1 as described in the foregoing embodiments, and may be a side mirror, for example.

The invention is applicable not only to cars as described in the embodiments, but also to any other kind of vehicle such as railroad trains or vessels.

What is claimed is:

1. A driver illuminating apparatus adapted for use in a vehicle provided with a rear-view mirror, the driver illuminating apparatus comprising:

a light emitting element mounted within a rear field of vision of a driver in a driver seat through the rear-view mirror, the light emitting element being adapted to emit infrared radiation toward the rear-view mirror.

2. The driver illuminating apparatus according to claim 1, wherein the light emitting element is mounted approximately at center of a rear window of the vehicle.

3. A vehicle driver image capturing apparatus adapted for use in a car provided with an interior rear-view mirror, the driver image capturing apparatus comprising:

the driver illuminating apparatus of claim 2; and a camera mounted so as to be directed at a face of the driver.

4. A driver image capturing apparatus adapted for use in a vehicle provided with a rear-view mirror, the driver image capturing apparatus comprising:

the driver illuminating apparatus of claim 1; and a camera mounted so as to be directed at a face of the driver.

5. The driver image capturing apparatus according to claim 4, wherein the camera is a CMOS camera with logarithmic response to light intensity.

6. The driver image capturing apparatus according to claim 4, wherein the camera is sensitive to near-infrared radiation and insensitive to visible light.

7. A driver monitoring apparatus adapted for use in a vehicle provided with a rear-view mirror, the driver monitoring apparatus comprising:

the driver image capturing apparatus of claim 4; and an image processing device adapted to detect a face or eyes of the driver from an image captured by the driver image capturing apparatus and to determine condition of the driver based on the facial or eye image as detected.

8. The driver monitoring apparatus according to claim 7, further comprising a warning section, wherein the image processing device is adapted to detect an area that is illuminated by the light emitting element and, in the event that the eyes of the driver are positioned outside the illuminated area, to instruct the warning section to provide a warning to the driver.

9. The driver monitoring apparatus according to claim 8, wherein the image processing device is adapted to detect, and notifies the warning section of, a first direction in which the illuminated area is misaligned from the eyes, and wherein the warning section provides a warning to the driver to adjust the rear-view mirror in a second direction opposite to the first direction.

10. The driver monitoring apparatus according to claim 7, further comprising a warning section, wherein the image processing device is adapted to detect duration of eyelid closure based on the detected eye image and, upon detection that the detected duration is longer than a predetermined level, to instruct the warning section to provide a warning to the driver.

11. The driver monitoring apparatus according to claim 10, wherein the warning section is adapted to output an audible alarm.

12. The driver monitoring apparatus according to claim 10, wherein the warning section is adapted to shake a driver seat.

13. The driver monitoring apparatus according to claim 7, further comprising a warning section, wherein the image processing device is adapted to detect a direction of the eyes based on the detected eye image and, upon detection that the eyes are directed in a direction other than frontward for more than a predetermined period of time, to instruct the warning section to provide a warning to the driver.

14. The driver monitoring apparatus according to claim 13, wherein the warning section is adapted to output an audible alarm.

15. The driver monitoring apparatus according to claim 13, wherein the warning section is adapted to shake a driver seat.

16. A driver illuminating apparatus adapted for use in a vehicle provided with a rear-view mirror, the driver illuminating apparatus comprising:

a light emitting element mounted out of a rear field of vision of a driver in a driver seat through the rear-view mirror, the light emitting element being adapted to emit infrared radiation to be reflected by a cold filter and delivered to the rear-view mirror, the cold filter being provided in part or whole of a portion of a rear window of the vehicle, the portion being located within the rear field of vision.

17. The driver illuminating apparatus according to claim 16, wherein the light emitting element is mounted outside range of a rear window of the vehicle, and wherein the cold filter being provided in a central area of the rear window.

18. A driver image capturing apparatus adapted for use in a car provided with an interior rear-view mirror, the driver image capturing apparatus comprising:

the driver illuminating apparatus of claim 17; and a camera mounted so as to be directed at a face of the driver.

19. A driver image capturing apparatus adapted for use in a vehicle provided with a rear-view mirror, the driver image capturing apparatus comprising:

the driver illuminating apparatus of claim 16; and a camera mounted so as to be directed at a face of the driver.

* * * * *